US009924746B1

(12) United States Patent
Davis

(10) Patent No.: US 9,924,746 B1
(45) Date of Patent: Mar. 27, 2018

(54) ANTI-CHAFING UNDERWEAR

(71) Applicant: Timothy Davis, Lancaster, NY (US)

(72) Inventor: Timothy Davis, Lancaster, NY (US)

( * ) Notice: Subject to any disclaimer, the term of this patent is extended or adjusted under 35 U.S.C. 154(b) by 35 days.

(21) Appl. No.: 15/279,940

(22) Filed: Sep. 29, 2016

(51) Int. Cl.
*A41B 9/02* (2006.01)
*A41B 9/00* (2006.01)
*A41B 9/12* (2006.01)

(52) U.S. Cl.
CPC ..... *A41B 9/12* (2013.01); *A41B 9/001* (2013.01); *A41B 9/002* (2013.01); *A41B 9/02* (2013.01)

(58) Field of Classification Search
CPC .. A41B 9/023; A41B 9/02; A41B 1/08; A41B 9/004; A41B 17/00; A41B 9/00; A41B 9/14; A61F 13/4915; A61F 13/56; A61F 13/72
See application file for complete search history.

(56) References Cited

U.S. PATENT DOCUMENTS 2,033,551 A * 3/1936 Rumery ..... A61F 5/40 2/404
3,517,666 A * 6/1970 Atlee ..... A41B 9/02 2/403
3,945,051 A 3/1976 Burkard
4,870,958 A 10/1989 Webster
5,029,345 A * 7/1991 Angheluta ..... A41B 9/023 2/403
5,070,869 A 12/1991 Zhang
5,237,706 A * 8/1993 Nalbandian ..... A41B 9/023 2/403
5,870,779 A 2/1999 Heron
6,289,520 B1 9/2001 Page
7,676,853 B1 * 3/2010 Cutlip ..... A41B 9/023 2/400
7,958,571 B2 * 6/2011 Kitsch ..... A41B 9/023 2/403
9,687,030 B2 * 6/2017 Bigney ..... A41B 9/023
2004/0025218 A1 * 2/2004 Huang ..... A41B 9/023 2/73
2005/0066423 A1 * 3/2005 Hogan ..... A41D 1/084 2/227
2005/0278831 A1 * 12/2005 Dahlquist ..... A41B 9/02 2/403
2008/0109945 A1 * 5/2008 Xia ..... A41B 9/023 2/403

(Continued)

*Primary Examiner* — Bobby Muromoto, Jr.
(74) *Attorney, Agent, or Firm* — Vincent G. LoTempio; Kloss, Stenger & LoTempio; David T. Stephenson

(57) ABSTRACT

An anti-chafing underwear minimizes abrasive skin-to-skin contact on all skin surfaces from the mid-thigh to the waist, including the skin of the upper thigh, between the buttocks in the gluteal fold, inner thigh, scrotum, and the phallus, while retaining the genitals, the phallus, and scrotum in a relaxed position. The underwear includes a waistband, a left panel, a right panel, a center panel, and a front panel. The lower left and right panels wrap around the thighs. Left top edge and right top edges of the left and right panels are fastened to the waistband and overlap at the rear of the waistband. Left and right upper depressed edges of the left and right panels overlap each other to separate and cover the buttocks. The front panel covers the phallus, forming a channel for natural retention of phallus. The center panel forms a channel for natural retention of scrotum.

19 Claims, 3 Drawing Sheets

(56) References Cited

U.S. PATENT DOCUMENTS

| | | | | |
|---|---|---|---|---|
| 2008/0178369 | A1* | 7/2008 | Kitsch | A41B 9/023 2/405 |
| 2009/0106874 | A1* | 4/2009 | Shlush | A41B 9/023 2/78.1 |
| 2009/0149827 | A1* | 6/2009 | Mlinar | A61F 13/4902 604/385.14 |
| 2009/0178182 | A1* | 7/2009 | Dahlquist | A41B 9/02 2/401 |
| 2010/0037368 | A1* | 2/2010 | Stearns | A41B 9/08 2/227 |
| 2010/0170028 | A1* | 7/2010 | Edwardsen | A41B 9/023 2/404 |
| 2012/0117700 | A1* | 5/2012 | Howell | F41H 1/02 2/2.5 |
| 2012/0167279 | A1* | 7/2012 | Bigney | A41B 9/023 2/401 |
| 2013/0019365 | A1* | 1/2013 | Howell | F41H 1/02 2/2.5 |
| 2013/0291879 | A1* | 11/2013 | Matsuda | A61F 2/0009 128/885 |
| 2014/0237704 | A1* | 8/2014 | Mehrabian | A41B 9/023 2/404 |
| 2015/0181946 | A1* | 7/2015 | Donmoyer | A41B 9/023 2/403 |
| 2015/0282996 | A1* | 10/2015 | Newton | A61F 13/4915 604/385.14 |
| 2015/0313290 | A1* | 11/2015 | Bigney | A41B 9/023 2/401 |
| 2016/0100635 | A1* | 4/2016 | Rankin | A41B 9/026 2/405 |
| 2016/0206010 | A1* | 7/2016 | Lee, III | A41B 9/023 |
| 2017/0079836 | A1* | 3/2017 | Mahon | A61F 7/103 |
| 2017/0095008 | A1* | 4/2017 | Klein | A41B 9/02 |

* cited by examiner

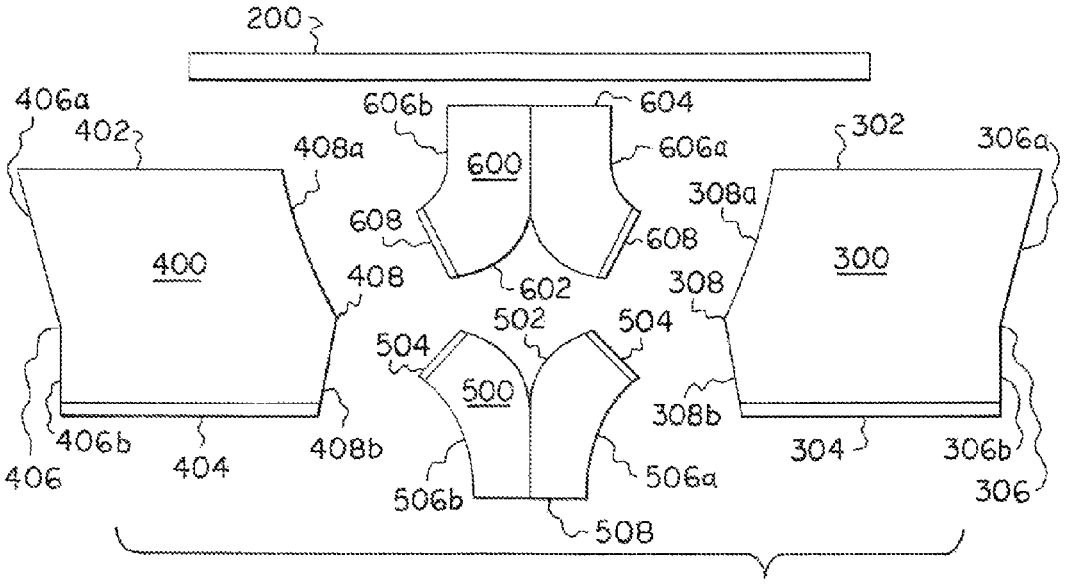
FIG. 5
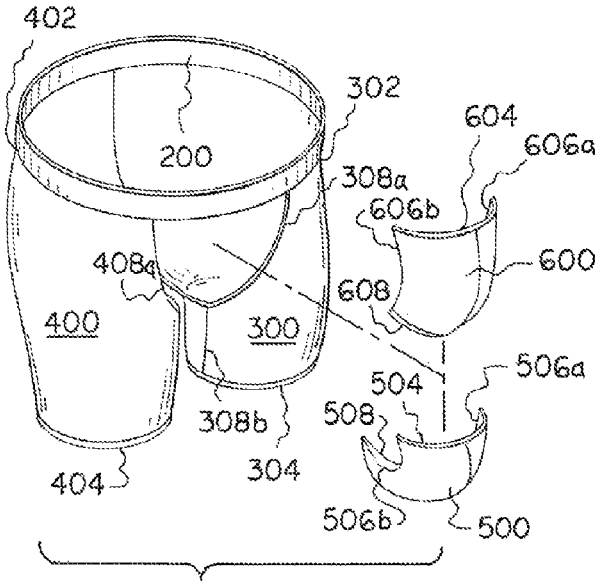
FIG. 6
FIG. 7
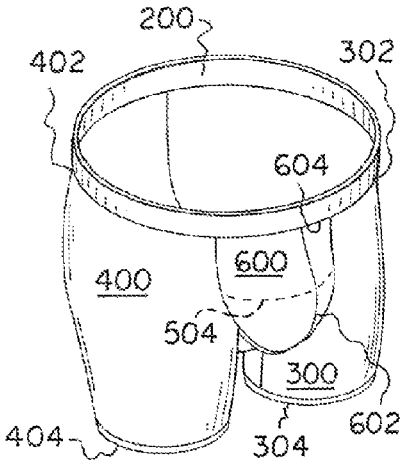

ANTI-CHAFING UNDERWEAR

FIELD OF THE INVENTION

The present invention relates generally to an anti-chafing underwear. More so, the anti-chafing underwear provides a protective underwear for males that is configured to minimize abrasive skin-to-skin contact on all skin surfaces from the wearer's mid-thigh up to the waist, including the skin of the upper thigh, between the buttocks to the gluteal fold, the inner thigh, the scrotum, and the phallus, while still retaining the genitals in their natural relaxed position; whereby the anti-chafing underwear comprises a waistband, a left panel, a right panel, a center panel, and a front panel that are fastened together or overlapped to form barriers against skin to skin contact and chafing; whereby the center panel and front panel form channels for retaining the scrotum and phallus separately in a natural position.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that underwear is a type of undergarment that is worn under outer garments, such as pants or shorts, often next to the skin. Underwear help keep outer garments from contamination by dirt or sweat and protect body parts against chafing from contact of outerwear. Underwear also serve to shape the body and provide support for parts of it, and in cold weather help the wearer to keep warm. Underwear can be used to support the male genitals.

In many instances, underwear is fabricated from an elastic waistband which completely encompasses the wearer's waist. However, the presence of such resilient material across the abdomen can restrict breathing and reduce comfort. Further, men's underwear also frequently include elastic material surrounding the openings for the wearer's legs. When elastic material is affixed by stitching in a much elongated condition to the textile material of which the garment is made in the area about these openings, then bunching of the underwear can cause both chafing and discomfort.

In addition, the design and pattern of the textile material commonly used to make a substantial portion of the anterior side of underwear often includes an elastic or stretchable material, or a textile material which otherwise exhibits considerable resilience. When donned, such men's underwear will commonly exert force upon the male reproductive organs, that is, the penis, and the scrotum containing the testicles. This force elevates and presses the male reproductive organs against the pubic area of the torso or between the wearer's legs. Accordingly, such restrictive underwear do not permit the male reproductive organs to be suspended naturally.

Generally, it is not unusual for a wearer to experience discomfort when rubbing or chafing occurs between the heavy inner thighs of both legs in the crotch. Such discomfort or irritation may be enhanced at higher temperatures in hot climates and particularly for obese and physically active individuals. To help solve this constraint issue, looser fitting underwear, such as boxers can be worn. With boxers, air draft is good during the use.

However, during the use of boxers, a cuticle of a testicle is liable to adhere closely to the inside of a thigh. Therefore, there is feeling of physical disorder. In order to eliminate this feeling of physical disorder, during driving, physical active or in the presence of other people, it may be possible that while legs are opened the adhering is released or the location of the pubic region is changed. However, it is difficult to conduct such action during physical activity and driving, because of interference with driving or the physical activity. Also it is difficult to conduct such action in the presence of other people, because of embarrassment.

It is known that a relaxed, natural position for the genitals helps to lower the temperatures to which the testicle is subjected. Also, by reducing chafing between the inner thighs, heat may be reduced. In this manner, the rate and quality of spermatogenesis is increased, and greater heat dissipation is facilitated. In addition, the natural position of the testicle and phallus positively influences the operation of sex hormones and metabolism.

Other proposals have involved male undergarments that prevent chafing and comfortable support of the genitals. The problem with these undergarments is that they do not provide a built in barrier between the buttocks, the thighs and the genitals, while also retaining the scrotum, the testicles and phallus in a natural position. Even though the above cited male underwear meets some of the needs of the market, an anti-chafing underwear provides a protective underwear for males that is configured to minimize abrasive skin-to-skin contact from the wearer's mid-thigh up to the waist, including the skin between the buttocks, of the upper thigh, the inner thigh, the scrotum, the testicles, and the phallus, while still retaining the genitals in their natural relaxed position is still desired.

SUMMARY OF THE INVENTION

The present invention is directed to an anti-chafing underwear that is configured to be donned beneath an outer garment and provide a protective, comfortable undergarment for a male wearer. The anti-chafing underwear is specifically configured to minimize abrasive skin-to-skin contact from the mid-thigh up to the waist. The anti-chafing underwear is also configured to help retain the genitals in a natural position.

The anti-chafing underwear utilizes a waistband and four panels that overlap and fasten together at strategic points to form the general shape and dimensions of the underwear, to form a barrier between the buttocks, thighs and the genitals, and to retain the genitals in a separated natural position. In this manner, abrasive contact is minimized between the buttocks, thighs and the genitals, including the skin between the buttocks, of the upper thigh, the inner thigh, the scrotum, and the phallus. The anti-chafing underwear also permits the male reproductive organs to be suspended naturally.

In some embodiments, the anti-chafing underwear may include a waistband, a left panel, a right panel, a center panel, and a front panel. The waistband and the panels are overlapped at strategic areas and stitched together to form the general shape and dimensions of the underwear. In some embodiments, the waistband is generally annular and encircles the waist. The waistband is configured to support the panels from the waist of a wearer. The panels are configured to hang from the waistband, while at least partially overlapping each other; thereby creating a synergy that prevents chafing by placing a fabric barrier between the buttocks, thighs and genitals, and retains the genitals in a natural position.

In some embodiments, the left panel comprises a left top edge, a left bottom edge, a left depressed edge, and a left protruding edge. The left panel follows a generally elongated, V-shape. The left panel is configured, by fastening the lower portion of the left depressed edge to the lower portion of the left protruding edge to align with the longitudinal axis of the left leg and at least partially wrap around the left thigh, forming an opening that accommodates the left leg. The left top edge of the panel is configured to join with the waistband.

The right panel is substantially identical to the left panel, but is reversed in the direction perpendicular to the surface of the left panel, i.e., mirror image. The right panel comprises a right top edge, a right bottom edge, a right depressed edge, and a right protruding edge. The right top edge is configured to join with the waistband. The right panel, by fastening the lower portion of the right depressed edge to the lower portion of the right protruding edge is configured to align with the longitudinal axis of the right leg and at least partially wrap around the right thigh, forming an opening that accommodates the right leg. The right panel follows a generally elongated, V-shape.

The left top edge of the left panel and the right top edge of the right panel overlap each other where they are fastened to the rear of the waistband. Further, the left and right panels overlap each other over most of their respective depressed edges, with the upper portion of the depressed edges between the buttocks following the gluteal fold and covering the buttocks and the rear and lateral regions of the thighs. This overlapping also forms a barrier between the rear and lateral regions of the thighs.

However, the left and right panels have a spaced-apart relationship at their respective protruding edges, leaving a gap across the lower abdomen, the genitals and the front of the thighs. Thus, at the genitals, the left and right panels do not engage or overlap each other, remaining separate.

In some embodiments, the center panel comprises a center scrotum edge that folds upward and that orients rearward behind the scrotum, a center waist edge that orients towards the waistband, and a pair of center thigh edges that orient towards the inner region of the thighs, between the inner thighs and the scrotum.

The center panel is disposed between the left and right panels. The center panel fastens to the left panel and the right panel. Specifically, the pair of center thigh edges of the center panel fasten to the left upper depressed edge and left upper protruding edge of the left panel and the right upper depressed edge and right upper protruding edge of the right panel.

The center panel is configured to extend between the inner region of the left and right thighs, while covering the scrotum. The center panel is thus, in a position to serve as a barrier between the inner regions of the thighs; thereby inhibiting chafing between inner region of the left and right thighs, while forming a fabric barrier between the scrotum, the phallus, and any outerwear.

The center scrotum edge of the center panel folds upward. This folded configuration forces the center panel into a generally V-shaped or U-shaped channel. The channel is configured to retain the genitals, and specifically the scrotum, in the natural position. The natural position allows the scrotum and the phallus to fall naturally while placing a fabric barrier between the scrotum and phallus. While retained in the center panel, the scrotum cannot contact the phallus, the inner region of the thighs, or any outerwear; thereby inhibiting chafing between the scrotum, the thighs and any outerwear.

In some embodiments, the front panel comprises a front scrotum edge that orients towards the scrotum, a front waist edge that orients towards the waistband, and a pair of front thigh edges that orient towards the inner region of the thighs. In one embodiment, the front scrotum edge may be wider than the front waist edge.

The front panel overlaps the center panel, and fastens to the left panel, and the right panel and the waistband. The front panel extends across the gap that forms between the left protruding edge of the left panel and the right protruding edge of the right panel. The front waist edge of the front panel fastens to the waistband. The front scrotum edge overlaps about half of the center panel. The pair of front thigh edges of the front panel fasten to the left and right protruding edges of the left and right panels. The front waist edge fastens to the waistband.

The front panel begins fairly flat at the waistband and develops a concave shape as it continues downward overlapping about half of the center panel, thus creating additional space for comfortably retaining the phallus in front of the scrotum. The additional space formed by the concave shape helps retain the scrotum and the phallus in the natural position, and provides a fabric barrier between the lower abdomen, the phallus, and any outerwear.

In one aspect, an anti-chafing underwear comprises:

a waistband, the waistband defined by a generally annular shape, the waistband configured to enable encircling of a waist;

a left panel, the left panel configured to enable a wrapping around an upper left thigh, the left panel defined by a left top edge, a left bottom edge, a left depressed edge, and a left protruding edge, the left top edge configured to fasten to the waistband, the left panel lower depressed edge configured to fasten to the left lower protruding edge the left upper depressed edge configured to overlap the right upper depressed edge of the right panel;

a right panel, the right panel configured to enable a wrapping around a right thigh, the right panel defined by a right top edge, a right bottom edge, a right depressed edge, and a right protruding edge, the right top edge configured to fasten to the waistband, the right panel lower depressed edge configured to fasten to the right lower protruding edge, the right upper depressed edge configured to overlap the left upper depressed edge of the left panel, whereby the left panel and the right panel are configured to from a barrier between an inner region of the left and right thighs, the buttocks and the scrotum;

a center panel, the center panel defined by a center scrotum edge disposed to orient towards the rear, the center panel further defined by a center waist edge disposed to orient towards the waistband, the center panel further defined by a pair of center thigh edges disposed to orient towards the inner region between the scrotum and the left and right thighs, the center scrotum edge of the center panel configured to fold upward, the pair of center thigh edges of the center panel configured to fasten to the left depressed and protruding edge of the left panel and the right depressed and protruding edge of the right panel, whereby the center panel is configured to form a barrier between the inner region of the left and right thighs and a scrotum and the phallus, and any outerwear; and a front panel, the front panel defined by a front waist edge disposed to orient towards the waist, the front panel further defined by a front scrotum edge disposed to orient towards the scrotum, the front panel further defined by a pair of front thigh edges disposed to orient towards the inner region of the left and right thighs, the front waist edge of the front panel configured to fasten to the waistband, the front scrotum edge of the front panel configured to overlap the center waist edge and about half of the center panel, the pair of front thigh edges of the front panel configured to fasten to the left and right protruding edges of the left and right panels, the front panel further defined by a generally concave shape, whereby the generally concave shape of the front panel is configured to enable at least partial retention of the phallus and the scrotum.

In another aspect, the anti-chafing underwear includes at least one benefit selected from members of the group consisting of: a male underwear, a body liner, a boxer short, a brief, an athletic supporter, a thong-style underwear, and an undergarment.

In another aspect, the waistband is generally elastic.

In another aspect, a material of the anti-chafing underwear includes at least one member selected from the group consisting of: polyester, nylon, cotton, spandex, rubber, polyurethane, and a synthetic or natural material.

In another aspect, the left panel and the right panel top edges are fastened to the waistband, and specifically at the rear region of the waistband in an overlapped fashion.

In another aspect, the left panel and the right panel are configured to form a barrier between the buttocks.

In another aspect, the left panel and the right panel are configured to form a barrier between the thighs and the outer garment.

In another aspect, the left panel and the right panel are configured to form a barrier between the upper inner thighs and the scrotum.

In another aspect, the center panel is configured to form a barrier between the inner region of the thighs and the scrotum and any outerwear.

In another aspect, the center panel left center thigh edge and portions of the left panel upper protruding edge and upper depressed edge are sewn together.

In another aspect, the center panel right center thigh edge and portions of the right panel upper protruding edge and upper depressed edge are sewn together.

In another aspect, the overlapping between the front panel and the center panel along the center thigh edges are sewn together.

In another aspect, the edge between the front panel and the left panel is sewn together.

In another aspect, the edge between the front panel and the right panel is sewn together.

In another aspect, the front panel waist edge and the waistband are sewn together It is one objective of the present invention to provide an anti-chafing underwear that minimizes abrasive skin-to-skin contact on all skin surfaces from the mid-thigh up to the waist.

It is another objective to provide an anti-chafing underwear that helps retain the genitals in a natural position; whereby the natural position allows the scrotum and the phallus to fall naturally towards the center panel with minimal constraint.

Yet another objective is to provide an anti-chafing underwear that provides male support without constricted leg openings.

Yet another objective is to provide an anti-chafing underwear that that do not substantially limit or restrict freedom of movement of the wearer's legs or trunk.

Yet another objective is to sew the fastened panels and waistband together, so as to reinforce the junctions.

It is another objective to provide an anti-chafing underwear that is relatively simple in construction and inexpensive to manufacture.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 5 illustrates a top pattern view of the anti-chafing underwear shown in FIG. 1, with the panels fully detached from each other, in accordance with an embodiment of the present invention;

FIG. 6 illustrates a perspective view of the anti-chafing underwear shown in FIG. 1, with a front panel and a center panel fully detached, in accordance with an embodiment of the present invention;

FIG. 7 illustrates a perspective view of the anti-chafing underwear shown in FIG. 1, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIGS. 1-11 illustrate an exemplary anti-chafing underwear 100. The anti-chafing underwear 100 helps minimize abrasive skin-to-skin contact from the mid-thigh to the waist, including the skin of the upper thighs, between the buttocks 704, an inner region of the left and right thighs, a scrotum 702, and a phallus 700. The anti-chafing underwear 100, hereafter "underwear" 100, also serves to retain a phallus 700 and a scrotum 702 in a relaxed, natural position.

Figure 1:
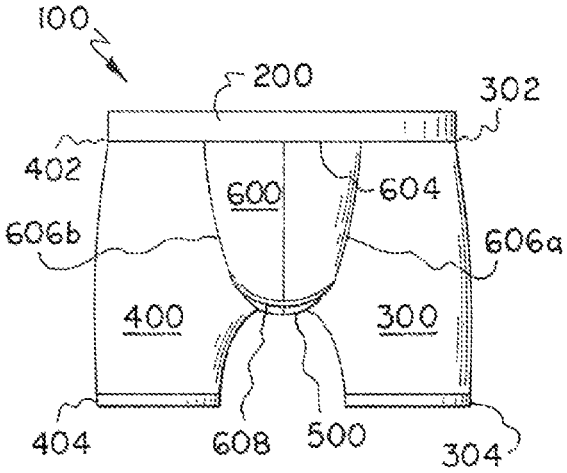
FIG. 1 illustrates a frontal view of an exemplary anti-chafing underwear, in accordance with an embodiment of the present invention.
Figure 2:
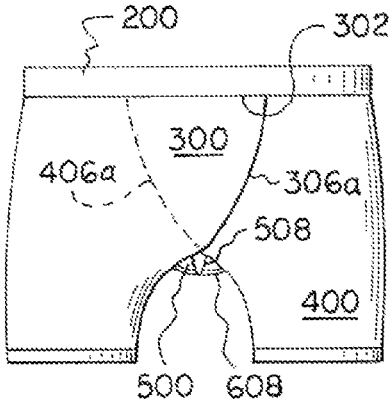
FIG. 2 illustrates a rear view of the anti-chafing underwear shown in FIG. 1, in accordance with an embodiment of the present invention.

Looking now at FIGS. 1 and 2, underwear 100 comprises a waistband 200, a left panel 300, a right panel 400, a center panel 500, and a front panel 600. The left and right panels 300, 400 wrap around their respective left and right thighs. The left and right panels 300, 400 comprise a left top edge 302 and a right top edge 402 that are fastened to the waistband 200.

Figure 3:
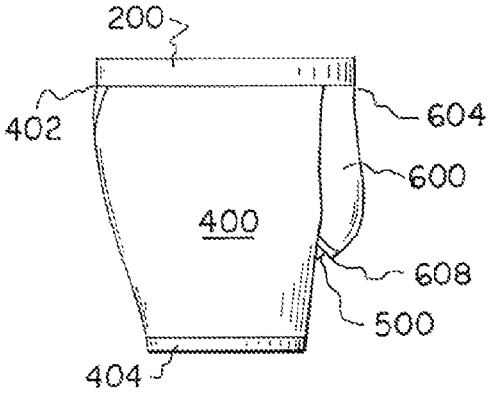
FIG. 3 illustrates a right side view of the anti-chafing underwear shown in FIG. 1, in accordance with an embodiment of the present invention.

In some embodiments, left and right panels 300, 400 further comprise a left depressed edge 306 and a right depressed edge 406 that overlap each other to separate and cover the buttocks and rear region of the thighs. Left and right panels 300, 400 further comprise a left protruding edge 308 and a right protruding edge 408 having a spaced-apart relationship that creates a gap across the lower abdomen and the genitals, i.e., a phallus 700, a testicle, and a scrotum 702 (FIG. 3).

Figure 4:
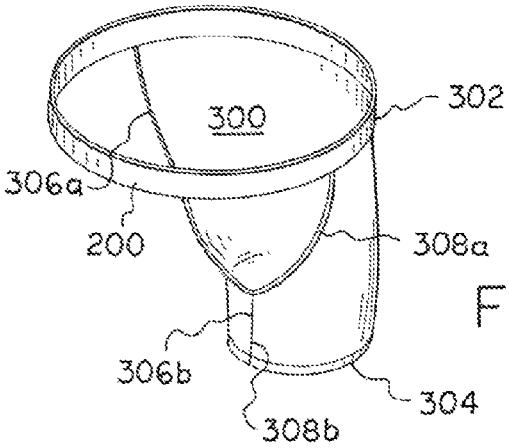
FIG. 4 illustrates perspective view of the anti-chafing underwear shown in FIG. 1, with the right panel, front panel and center panel removed, in accordance with an embodiment of the present invention.

By removal of right panel 400, the center panel 500 and the front panel 600, in FIG. 4, it is shown that the upper left depressed edge 306*a* and the upper left protruding edge 308*a* form a U-shaped line that is configured to run from the user's waistband, down the lower abdomen 710, between the left inner thigh and the scrotum, across the perineum 712, between the buttocks 704 up along the gluteal fold 706, to the rear of the waistband 200.

In some embodiments, underwear 100 may be manufactured and worn without the front panel 600, and the center panel 500, as a "sub-underwear" or body liner underneath and in conjunction with boxer shorts, briefs or an athletic supporter, as to the genital retention preference of the wearer.

Anti-chafing underwear 100 is configured to be donned beneath an outer garment while providing a protective, comfortable undergarment for a male wearer. Underwear 100 is specifically configured to help minimize abrasive skin-to-skin contact from the mid-thigh up to the waist. Underwear 100 is also configured to help retain the phallus 700 and the scrotum 702 in the natural position. In this manner, relatively unrestricted flexion and extension of the legs is permitted. Also, a barrier between the buttocks 704, an inner region of the left and right thighs, the phallus 700, and the scrotum 702 forms to help reduce chafing and enhance comfort.

In some embodiments, underwear 100 may include, without limitation, benefits from or characteristics of a male underwear, a body liner, a boxer short, a brief, a thong-style underwear, an athletic supporter and an undergarment. The outer garment may include a pair of pants, a pair of shorts, and a long john. Suitable materials for underwear 100 may include, without limitation, polyester, nylon, cotton, spandex, rubber, polyurethane, and a natural or synthetic material.

As discussed above, underwear 100 utilizes four different panels 300, 400, 500, 600 that are fastened together to form a barriers between the buttocks 704, between the thighs, the phallus 700, and the scrotum 702, and also to comfortably support the phallus 700, and the scrotum 702 in the natural position.

In this manner, abrasive contact is minimized between the buttocks 704, between the thighs, including the skin of the upper thigh, the inner thigh, the scrotum 702, and the phallus 700. In one embodiment, the fastened panels 300, 400, 500, 600 and the waistband 200 are sewn together to form a reinforcing seam there between. Panels 300, 400, 500, 600 are also shaped and dimensioned, so as to permit the male reproductive organs to be suspended naturally.

Turning now to the individual panels 300, 400, 500, 600 illustrated in the top pattern view of FIG. 5, underwear 100 may include a waistband 200, a left panel 300, a right panel 400, a center panel 500, and a front panel 600. Waistband 200 and panels 300, 400, are fastened at strategic areas and stitched together to form the general shape and dimensions of underwear 100. In some embodiments, waistband 200 is generally annular and encircles the waist. In one embodiment, waistband 200 is substantially elastic and resilient. In other embodiments, waistband 200 may be size adjustable.

Waistband 200 is configured to support panels 300, 400, 600 from the waist of a wearer, and panel 500 is supported by fastening to panels 300, 400. Panels 300, 400, 600 are configured to hang from waistband 200, while at least partially overlapping each other; thereby creating a synergy that prevents chafing between the buttocks 704, the inner region of the left and right thighs, the phallus 700, and the scrotum 702, while also retaining the phallus 700, and the scrotum 702 in a natural position.

In some embodiments, left panel 300 comprises a left top edge 302, a left bottom edge 304, a left depressed edge 306, and a left protruding edge 308. Left panel 300 may follow a generally elongated, V-shape, as shown in FIG. 5. Left panel 300 is configured to align with the longitudinal axis of the left leg and wrap around the left thigh, by fastening the lower left depressed edge 306*b* to a lower left protruding edge 308*b* forming an opening that accommodates the left leg. The left top edge 302 of left panel 300 is configured to fasten to the waistband 200. Left top edge 302 may also be sewn, buttoned, adhered, or stapled to waistband 200.

Looking now at FIG. 6, right panel 400 is substantially identical to left panel 300, but is reversed in the direction perpendicular to the surface of left panel 300, i.e., mirror image. Right panel 400 is configured to align with the longitudinal axis of the right leg and wrap around the right thigh, by fastening a lower right depressed edge 406*b* to the lower right protruding edge 408*b* forming an opening that accommodates the right leg. Right panel 400 may follow a generally elongated, V-shape.

As FIG. 7 illustrates, right panel 400 comprises a right top edge 402, a right bottom edge 404, a right depressed edge 406, and a right protruding edge 408. Right top edge 402 of the right panel 400 is configured to fasten to waistband 200. Similar to left top edge 302, the right top edge 402 may also be sewn, buttoned, adhered, or stapled to waistband 200.

Left top edge 302 of the left panel 300 and right top edge 402 of the right panel 400 overlap at the rear of the underwear and fasten to the waistband 200. Further, left and right panels 300, 400 overlap each other at their respective upper depressed edges, 306*a*, 406*a*, so as to provide a barrier between and cover the buttocks 704 and the rear and lateral regions of the thighs.

However, left and right panels 300, 400 are disposed in a spaced-apart relationship at their respective upper protruding edges 308*a*, 408*a*, leaving a gap across the lower abdomen 710, phallus 700 and the scrotum 702, and the front of the thighs. Thus, at the lower abdomen 710, phallus 700 and the scrotum 702, left and right panels 300, 400 do not engage or overlap each other, remaining separate.

In some embodiments, front panel 600 comprises a front center edge 602 that orients along the phallus 700, a front waist edge 604 that orients toward, and fastens to the waistband 200, a front scrotum edge 608, that orients toward the scrotum, and a pair of center thigh edges 606*a*, 606*b* that orient towards the inner region of the thighs.

In some embodiments, center panel 500 comprises a center edge 502 that orients along the scrotum 702, a center scrotum edge 508, a pair of center thigh edges 506*a*, 506*b*, and a center waist edge 504. Center panel 500 is configured to extend between the inner region of the left and right thighs, while covering the scrotum 702. Center panel 500 is disposed between left and right panels 300, 400. Center panel 500 fastens to left panel 300 and right panel 400. Specifically, the pair of center thigh edges 506*a*, 506*b* of center panel 500 fasten to the upper left depressed edge 306*a* and the upper left protruding edge 308*a* of left panel 300, and also the upper right depressed edge 406*a* and the upper right protruding edge 408*a* of right panel 400.

Center scrotum edge 508 of center panel 500 folds up to form a generally U-shape or V-shape. This folded configuration forces center panel 500 into a generally U-shaped or V-shaped channel with the center waist edge 504 spanning across the top front of the scrotum 702. The channel is configured to retain the scrotum 702 in the natural position. While retained in center panel 500, the scrotum 702 is inhibited from contacting the inner region of the left and right thighs and any outer garments; thereby inhibiting chafing between the phallus 700, the scrotum 702, the thighs, and any outer garments.

Figure 8:
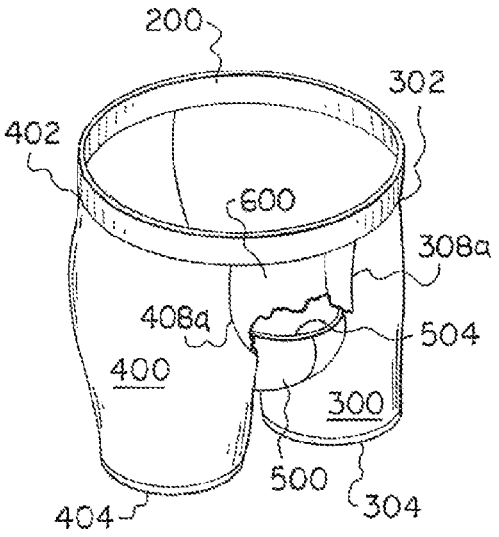
FIG. 8 illustrates a perspective view of the anti-chafing underwear shown in FIG. 1, with the front panel partially cut away, in accordance with an embodiment of the present invention.

FIG. 8 illustrates a front panel 600 partially cut away from underwear 100. Center panel 500 comprises a center waist edge 504 that orients towards the waist at the top front of the scrotum 702. In this manner, center panel 500 is thus, in a position to serve as a barrier between the scrotum, the phallus, the inner regions of the thighs, and any outer garments; thereby inhibiting chafing between inner region of the left and right thighs, the scrotum, the phallus, and any outer garments.

Figure 9:
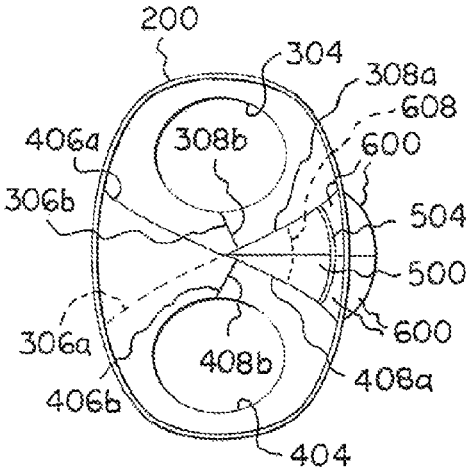
FIG. 9 illustrates an overhead top view of the anti-chafing underwear in accordance with an embodiment of the present invention.

FIG. 9 illustrates an overhead view of underwear 100. As illustrated, the nexus between panels 300, 400, 500, 600 forms centrally, where the phallus 700, the scrotum 702, and the inner thighs are susceptible to chaffing.

Figure 10:
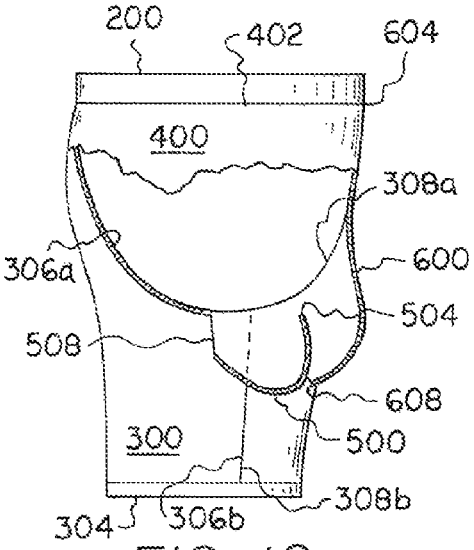
FIG. 10 presents a breakaway side view of anti-chafing underwear shown in FIG. 9, in accordance with an embodiment of the present invention.

FIG. 10 presents a breakaway side view of the anti-chafing underwear illustrating the path of the left upper depressed edge 306*a* and the left upper protruding edge 308*a* with the center panel 500 and the front panel 600 at the centerline of the an anti-chafing underwear.

Figure 11:
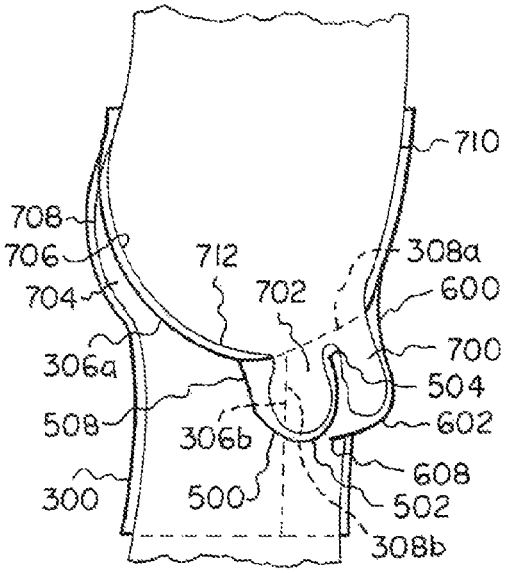
FIG. 11 presents a schematic side view of the anti-chafing underwear at the centerline, detailing the anti-chafing underwear as it relates to the male body parts when worn, in accordance with an embodiment of the present invention.

FIG. 11 presents a schematic side view of the anti-chafing underwear at the centerline illustrating the positions of the left upper depressed edge 306*a*, the left upper protruding edge 308*a*, the left lower depressed edge 306*b*, the left lower protruding edge 308*b*, the center panel 500, the center panel center edge 502, the center panel waist edge 504, the center panel scrotum edge 508, the front panel 600, the front panel center edge 602, the front panel scrotum edge 608, as they relate to the phallus 700, the scrotum, 702, the inner buttock, 704 the gluteal fold 706, the rear buttock edge 708, the lower abdomen 710, and the perineum 712, when worn by a male user.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An anti-chafing underwear, the underwear comprising:

a waistband, the waistband defined by a generally annular shape, the waistband configured to enable encircling of a waist;

a left panel, the left panel configured to enable wrapping around a left thigh, the left panel defined by a left top edge configured to fasten to the waistband, a left bottom edge, a left depressed edge, and a left protruding edge, the left depressed edge defined by an upper left depressed edge and a lower left depressed edge, the left protruding edge defined by an upper left protruding edge and a lower left protruding edge, the left lower protruding edge being configured to fasten to the left lower depressed edge;

a right panel, the right panel configured to enable a wrapping around a right thigh, the right panel defined by a right top edge configured to fasten to the waistband, a right bottom edge, a right depressed edge and a right protruding edge, the right depressed edge defined by an upper right depressed edge and a lower right depressed edge, the right protruding edge defined by an upper right protruding edge and a lower right protruding edge, the right lower protruding edge being configured to fasten to the right lower depressed edge, whereby the left panel top edge and the right panel top edge are fastened to the rear of the waistband in an overlapping fashion;

whereby the left panel and the right panel are configured to from a barrier between an inner region of the left and right thighs, a scrotum, between a buttocks, around the buttocks, and any outer wear;

a center panel, the center panel defined by a center scrotum edge disposed to fold upwardly behind the scrotum, the center panel further defined by a center edge, the center panel further defined by a center waist edge disposed to orient towards the waistband, the center panel further defined by a pair of center thigh edges disposed to orient towards an inner region between the left and right thighs, and the scrotum, the left center thigh edge of the center panel configured to fasten to the upper left depressed edge and the upper left protruding edge of the left panel, the right center thigh edge of the center panel further configured to fasten to the upper right depressed edge and the upper right protruding edge of the right panel, whereby the center panel is configured to form a barrier between the inner region of the left and right thighs and the scrotum, and any outerwear; and a front panel, the front panel defined by a front waist edge disposed to orient towards the waist, the front panel further defined by a front center edge, the front panel further defined by a front scrotum edge disposed to orient towards the scrotum, the front scrotum edge disposed to overlap about half of the center panel, the front panel further defined by a pair of front thigh edges disposed to orient towards the inner region of the left and right thighs, the front waist edge of the front panel configured to fasten to the waistband, the front scrotum edge of the front panel configured to overlap the center waist edge and about half of the center panel, the pair of front thigh edges of the front panel configured to fasten to the upper left protruding edge of the left panel and the upper right protruding edge of the right panel, the front panel further defined by a generally concave shape, whereby the generally concave shape of the front panel is configured to enable at least partial retention of the phallus and the scrotum.

2. The underwear of claim 1, wherein the anti-chafing underwear includes at least one member selected from the group consisting of: a male underwear, a body liner, a boxer short, a brief, a thong-style underwear, an athletic supporter, and an undergarment.

3. The underwear of claim 1, wherein the waistband is substantially elastic.

4. The underwear of claim 1, wherein a material of the anti-chafing underwear includes at least one member selected from the group consisting of: polyester, nylon, cotton, spandex, and polyurethane or any suitable natural or synthetic fabric.

5. The underwear of claim 1, wherein the left panel and the right panel are fastened to the waistband and overlap at a rear region of the waistband.

6. The underwear of claim 1, wherein the left panel and the right panel are configured to form a barrier between the buttocks, the upper thighs, the inner thighs, the scrotum, and an outer garment.

7. The underwear of claim 6, wherein the left panel and the right panel are configured to form a barrier between the left and right thighs and the outer garment.

8. The underwear of claim 7, wherein the front panel is configured to form a barrier between the lower abdomen, the phallus, and the outer garment.

9. The underwear of claim 8, wherein the center panel is configured to form a barrier between the inner region of the left and right thighs and the scrotum and the outer garment.

10. The underwear of claim 9, wherein the edges between the center panel and the left and right panels are sewn together.

11. The underwear of claim 10, wherein the edge between the front panel and the waistband are sewn together.

12. The underwear of claim 11, wherein the edge between the front panel and the left panel are sewn together.

13. The underwear of claim 12, wherein the edge between the front panel and the right panel are sewn together.

14. An anti-chafing underwear, the underwear comprising:

a waistband, the waistband defined by a generally annular shape;

a left panel, the left panel configured to enable wrapping around a left thigh, the left panel defined by a left top edge configured to fasten to the waistband, a left bottom edge, a left depressed edge, and a left protruding edge, the left depressed edge defined by an upper left depressed edge and a lower left depressed edge, the left protruding edge defined by an upper left protruding edge and a lower left protruding edge, the lower left depressed edge configured to fasten to the lower left protruding edge;

a right panel, the right panel configured to enable a wrapping around a right thigh, the right panel defined by a right top edge configured to fasten to the waistband, a right bottom edge, and a right protruding edge, the right depressed edge defined by an upper right depressed edge and a lower right depressed edge, the right protruding edge defined by an upper right protruding edge and a lower right protruding edge, the lower right depressed edge configured to fasten to the lower right protruding edge, whereby the left panel and the right panel are configured to enable the formation of a barrier between the buttocks, the upper thighs, the inner thighs and the scrotum, and an outer garment;

a center panel, the center panel defined by a center edge, the center panel further defined by a center scrotum edge, the center panel further defined by a center waist edge, the center panel further defined by a pair of center thigh edges, the center scrotum edge of the center panel configured to fold upward behind the scrotum, the left center thigh edge of the center panel configured to fasten to the upper left protruding and the upper left depressed edge of the left panel, the right center thigh edge of the center panel further configured to fasten to the upper right protruding and the upper right depressed edge of the right panel, whereby the center panel is configured to form a barrier between the inner thighs, the scrotum, and the outer garment; and a front panel, the front panel defined by a front waist edge, the front panel further defined by a front scrotum edge, the front panel further defined by a front center edge, the front panel further defined by a pair of front thigh edges, the front waist edge of the front panel configured to fasten to the waistband, the front scrotum edge of the front panel configured to overlap about half of the center panel, the pair of front thigh edges of the front panel configured to fasten to the upper left protruding edge and the upper right protruding edge of the left and right panels.

15. The underwear of claim 14, wherein the left panel and the right panel are configured to form a barrier between at least one of the following: the buttocks, an inner region of a left thigh, an inner region of a right thigh and the scrotum, and an outer garment.

16. The underwear of claim 15, wherein the center panel is configured to form a barrier between at least one of the following: the inner region of the left thigh, the scrotum, and certain outerwear.

17. The underwear of claim 16, wherein the center panel is configured to form a barrier between at least one of the following: the inner region of the right thigh, the scrotum, and an outerwear.

18. The underwear of claim 17, wherein a material of the anti-chafing underwear includes at least one member selected from the group consisting of: polyester, nylon, cotton, spandex, and polyurethane or any suitable natural or synthetic fabric.

19. The underwear of claim 18, wherein the underwear is manufactured without the center panel and the front panel for donning as a body liner or sub-underwear.

* * * * *